United States Patent [19]

Tusinski

[11] Patent Number: 4,563,916

[45] Date of Patent: Jan. 14, 1986

[54] DYNAMICALLY VARIABLE OSCILLATING ADJUSTMENT ASSEMBLY

[75] Inventor: Joseph Tusinski, Muskogee, Okla.

[73] Assignee: Coburn Optical Industries, Inc., Muskogee, Okla.

[21] Appl. No.: 530,086

[22] Filed: Sep. 7, 1983

[51] Int. Cl.[4] ..... F16H 35/08

[52] U.S. Cl. ..... 74/829; 51/68; 51/284 R; 74/43; 74/522; 74/834

[58] Field of Search ..... 74/43, 522, 829, 831, 74/834; 51/67, 68, 284 R

[56] References Cited

U.S. PATENT DOCUMENTS

| | | | |
|---|---|---|---|
| 721,994 | 3/1903 | Baker | 74/834 |
| 1,069,224 | 8/1913 | Bente | 74/834 X |
| 1,086,476 | 2/1914 | Smith | 74/834 |
| 1,226,549 | 5/1917 | McLain | 74/834 |
| 2,908,183 | 10/1959 | Di Giovanni | 74/522 X |
| 2,997,888 | 8/1961 | Rust, Jr. | 74/522 X |

*Primary Examiner*—William E. Tapolcai

*Attorney, Agent, or Firm*—John J. Byrne; Bradford E. Kile; Jameson Lee

[57] ABSTRACT

A dynamically variable oscillating adjustment assembly including a frame and a first link means pivotally connected at one end to the frame and an adjustment mechanism positioned intermediate the one end of the first link means and the frame to adjustably position the first link means with respect to the frame. A second link means pivotally connected at one end to the other end of the first link means and pivotally connected at the other end to a first arm of a bell crank pivotally mounted upon the frame. A second arm of the bell crank is operable to oscillate in response to oscillation of the other end of the first link means. An adjustment mechanism may be interposed between the frame and the intermediate pivot of the bell crank such that the position and stroke of the other arm of the bell crank may be selectively adjusted.

16 Claims, 5 Drawing Figures

DYNAMICALLY VARIABLE OSCILLATING ADJUSTMENT ASSEMBLY

BACKGROUND OF THE INVENTION

This invention relates to a dynamically variable oscillating adjustment assembly. More specifically, this invention relates to a dynamically variable adjustment assembly wherein stroke amplitude and a center position of oscillating movement may be selectively adjusted while the mechanism is oscillating.

In various oscillating stroke mechanisms it is desirable to adjust or vary a central position and stroke amplitude of the oscillating device. Presently known techniques require stopping a machine and relevant oscillation mechanism, making adjustments to eccentrics, linkages, arms, and the like and restarting the machine. The foregoing steps are repeated for as many iterations as are necessary to achieve the desired adjustment. The present invention does not require stopping the mechanism motion in order to make necessary adjustments. In this connection, adjustment is facilely achieved with the instant invention by dialing in a desired stroke and position while the machine is running.

While this invention is envisioned as having application in a number of environments, one context which is of particular interest is in the finishing or polishing of contact lenses. Contact lenses are initially formed with a substantially completed prescriptive value; however, a final polishing and finishing operation may be performed in order to ensure a smooth lens surface without aberrations, etc.

A lens polishing operation entails mounting a lens block carrying a contact lens upon a spindle within a polishing machine where the spindle is rapidly rotated about a central longitudinal axis of the lens. At the same time a polishing pad is mounted above the rapidly spinning lens and is oscillated back and forth over the lens as the lens spins. The above procedure has been found to provide sufficient variety of motion so as to avoid unwanted ridges or aberrations on the contact lens as finishing is achieved.

In lens polishing it is often desirable to change the position or stroke of oscillation of the polishing pad with respect to the contact lens. In the past when this adjustment of polishing pad position and amplitude of oscillation was desired, the polishing machine had to be stopped and various eccentrics and other arms were mechanically adjusted in length and then the machine was started again. Such down-time in any given machine which may simultaneously polish eight or more lenses is undesirable and it would be highly beneficial in the lens finishing art to be able to make position and stroke oscillation adjustments as a polishing machine is running.

OBJECTS OF THE INVENTION

Accordingly, it is a general object of the invention to provide a dynamically variable oscillating adjustment assembly which will facilelypermit variation in an oscillatory mechanism while a machine is running.

It is a particular object of the invention to provide a dynamically variable oscillating adjustment assembly wherein the width or stroke of oscillation of a mechanism may be varied during operation of a machine.

It is another object of the invention to provide a novel dynamically variable oscillating adjustment assembly wherein the position of oscillation of a mechanism may be advantageously adjusted while the machine is operating.

It is a further object of the invention to provide a dynamically variable oscillating adjustment assembly wherein stop and start adjustment iterations may be eliminated while achieving a desired position and stroke adjustment.

It is a specific object of the invention to provide a dynamically variable oscillating adjustment for a contact lens polishing machine wherein the position and stroke of oscillation of a polishing pad may be adjusted during an ongoing lens polishing operation.

BRIEF SUMMARY OF A PREFERRED EMBODIMENT OF THE INVENTION

A preferred embodiment of the invention, which is intended to accomplish at least some of the foregoing objects, comprises an adjustment assembly including a frame and a first link means pivotally connected at one end to the frame. A second link means is pivotally connected at one end to the other end of the first link means. A bell crank having a first arm and a second arm and an intermediate pivot is pivotally mounted upon the frame adjacent to the second link means. The first arm of the bell crank is pivotally connected to the other end of the second link means such that oscillation of the other end of the first link means operably serves to oscillate the second arm of the bell crank. Adjustment of the position and amplitude of stroke of the bell crank oscillation may be achieved by adjusting the position of the intermediate point of the bell crank with respect to the frame. Further stroke adjustment may be provided by adjusting the position of the first end of the first link means with respect to the frame.

THE DRAWINGS

Other objects and advantages of the present invention will become apparent from the following detailed description of a preferred embodiment thereof taken in conjunction with the accompanying drawings wherein.

Figures 3, 4, 5:
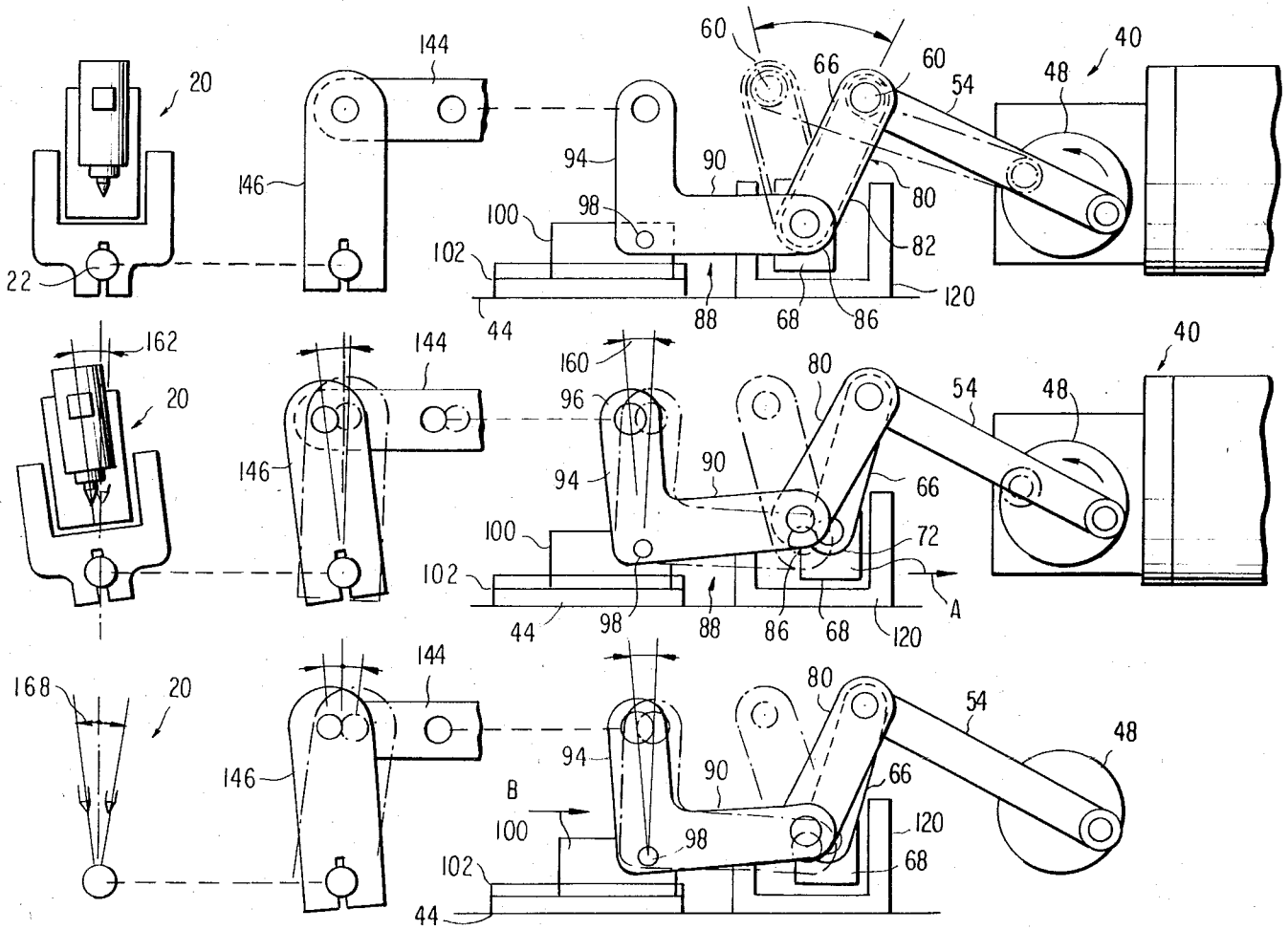
FIG. 3 is one position of possible adjustment of the instant assembly wherein no oscillatory motion is transmitted to a bell crank link and thus a lens polishing head.

FIG. 4 is a schematic illustration of adjustment of the pivot point of a first linkage means pivotally mounted to the frame of the lens polishing machine and a concomitant adjustment in the stroke of a lens polishing head; and FIG. 5 is a further schematic view wherein an adjustment to the position of an intermediate pivot of a bell crank is shown along with a resultant effect on the position of travel of the lens polishing member.

DETAILED DESCRIPTION

Context of the Invention

Figure 1:
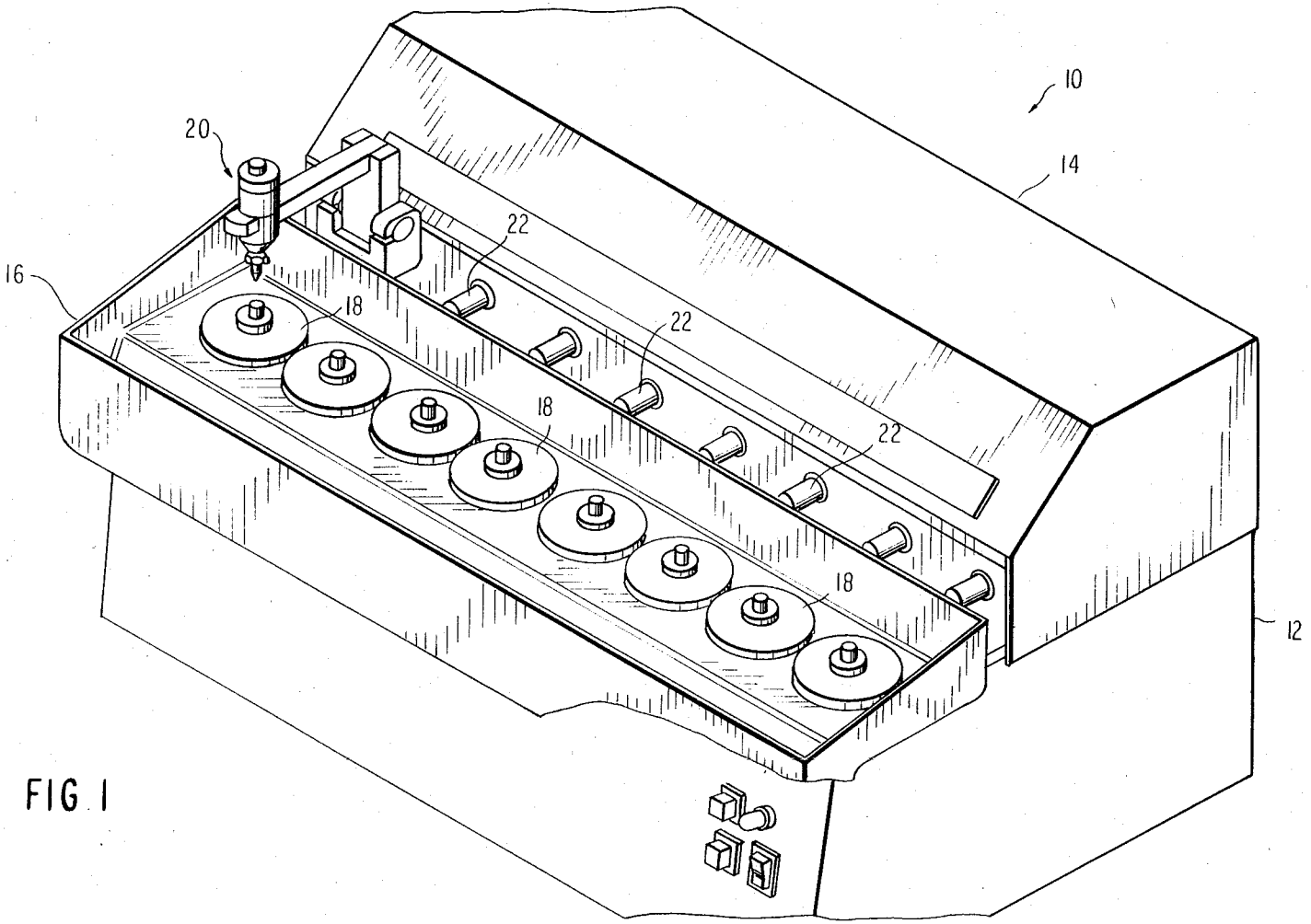
FIG. 1 is an axonometric view of a contact lens polisher-finer apparatus operable to advantageously utilize a dynamically variable oscillating stroke and position adjustment assembly in accordance with the subject invention.

Prior to describing in detail the structure of the subject dynamically variable oscillating adjustment assembly it may be worthwhile to briefly outline a typically operating context of the invention. In this connection FIG. 1 discloses a polisher-finer apparatus 10 wherein an upright cabinet 12 is disclosed having a block cover assembly 14 and a polishing tray 16 which serves in this particular instance to carry a set of eight spinners 18. Each of the spinners 18 operably carries an ophthalmic contact lens block and lens to be finished. A polishing head assembly 20 is releasably connected to an oscillating block shaft 22 and is operably driven in an oscillating, back-and-forth motion as will be discussed in detail hereinafter. In FIG. 1 only one polishing head assembly 20 is disclosed for ease of illustration. It will be appreciated by those skilled in the art, however, that each of the oscillating block shafts 22 will carry an assembly 20 so that a blocked contact lens mounted upon each spinner will have a corresponding polishing element oscillated back and forth over the lens surface during a finishing operation.

Figure 2:
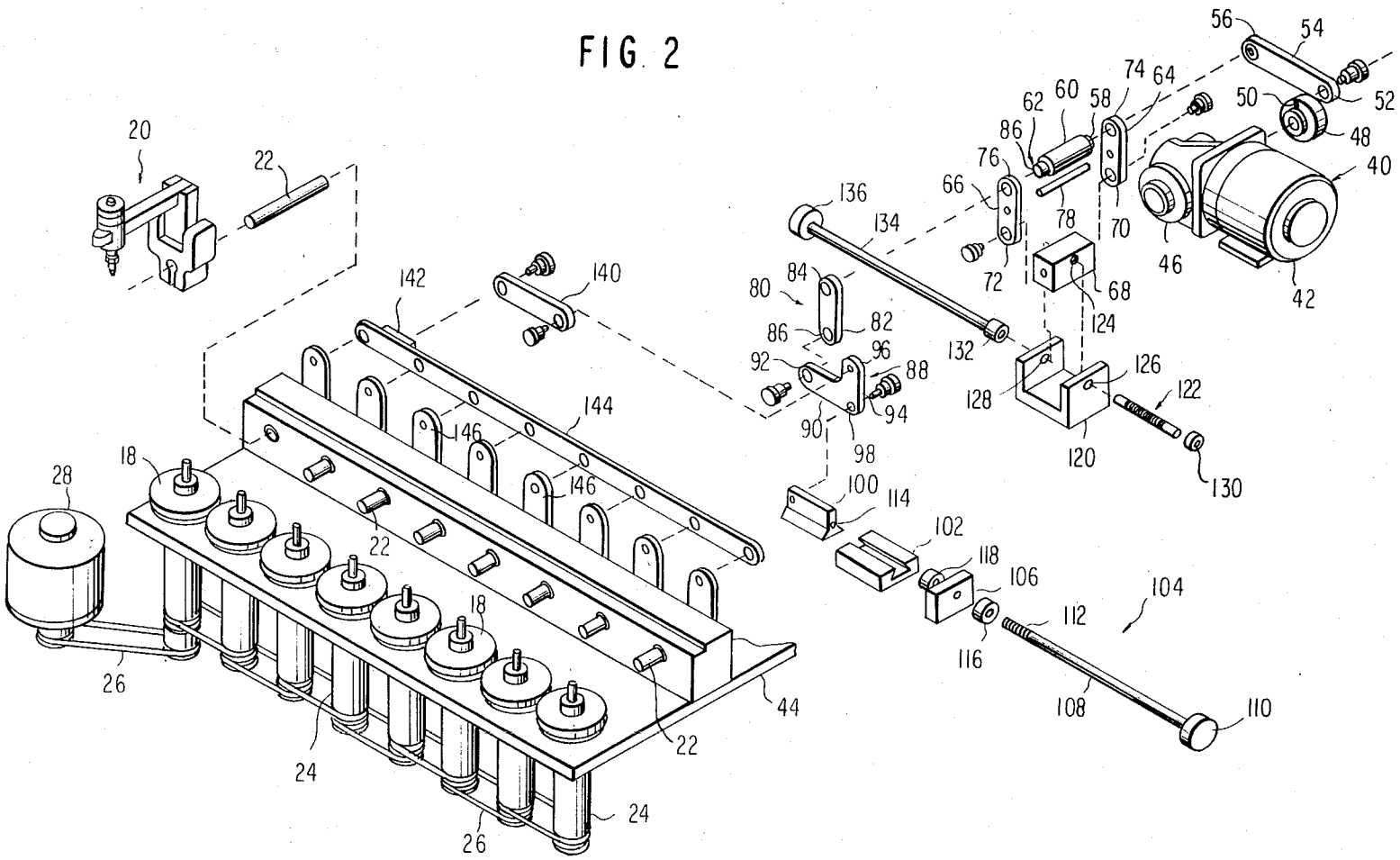
FIG. 2 is an exploded axonometric view of the detailed structure of the adjustment mechanism in accordance with the subject invention.

Further in the above connection and looking beneath the polishing tray 16, note FIG. 2, there will be seen a set of spinners 18 which are journalled upon corresponding spindle assemblies 24 serially connected by V-belts 26 to a drive motor 28. Accordingly, during a polishing operation the spinners 18 are rapidly rotated and advantageously spin a contact lens to be finished beneath a polishing surface.

Adjustment Assembly

Turning now to the instant invention, and according to a presently preferred embodiment, the oscillating motion system to be adjusted is driven by a gear motor combination 40 which includes a conventional electric motor 42 operable to be mounted upon a top plate 44 of a polishing machine. The gear motor combination 40 includes a reducing gear assembly or mechanism 46 which has an output shaft, not shown, splined to a drive cam 48. An aperture 50 is fashioned through the drive cam in a posture radially offset from the axis thereof and serves to rotatably receive one end 52 of a cam linkage 54. The other end 56 of the cam linkage 54 is pivotally connected to one end 58 of a drive stud shaft 60.

The drive stud shaft is a part of a first link means or assembly 62. Assembly 62 includes a first member 64 and a second identical and parallel mounted member 66. Members 64 and 66 are positioned on either side of a stroke set slide block 68. A first end 70 and 72 of the first and second members 64 and 66, respectively, are pivotally and coaxially mounted upon opposite ends of the stroke set slide block 68 and the other ends 74 and 76 of the first and second members, respectively, are pivotally and coaxially mounted at either end of the drive stud shaft 60. A main stroke drive balance bar 78 is positioned intermediate the ends of each of the first and second members and serves to maintain the rectangular posture of the elements of the first link assembly 62.

A second link means or assembly 80 comprises a member 82 having a first end 84 pivotally connected to the other end 86 of the drive stud shaft 60. Accordingly, the first end 84 lies in a coaxial posture with the other ends 74 and 76 of the first and second members 64 and 66, and the other end 56 of the cam drive link 54. The other end 86 of the member 82 is pivotally connected to a bell crank 88.

The bell crank 88 includes a first arm 90 which terminates with a first end 92 operable to be pivotally connected to the other end 86 of member 80. The bell crank has a second arm 94 which terminates with an outer end 96 which in turn is connected to lens polishing head assemblies 20.

The bell crank 88 is provided with an intermediate pivot 98 which is mounted upon a dovetail slide block 100. The slide block is received within a dovetail block 102 mounted upon the top plate 44. An adjustment mechanism 104 is provided for the bell crank slide 100 and includes a pillow block 106 also mounted upon the top plate 44. The pillow block operably receives a position adjustment mechanism 104 which may be a solid rod 108 having an adjustment knob 110 or a flexible stroke cable assembly as desired. In any case, and as illustrated in FIG. 2, the rod 108 is threaded at one end thereof as at 112 and is operably received through the stationary pillow block 106 and threadedly recieved into an axial thread 114 within the dovetail slide 100. Set collars 116 and 118 are positioned on either side of the pillow block 106 such that rotation of knob 110 will operably serve to translate the dovetail slide 100 within the dovetailed block 102. Accordingly, the intermediate pivot 98 of the bell crank 88 may be selectively translated along the dovetailed block 102. The effect of this translation will be discussed in detail below, but basically serves to position the center point of oscillation of the outer end 96 of the bell crank 88 and thus the rocking motion of the polishing head assemblies 20.

In addition to adjustment of the bell crank position, a preferred embodiment of the instant invention entails adjustment of the first link assembly 62. The stroke set slide block 68 is operably carried within a generally U-shaped set mount 120 which is operably fixed to the common top plate 44 of the polishing machine. A stroke length adjustment shaft 122 is threaded and operably extends through a corresponding threaded aperture 124 through the stroke set slide block 68. Each end of the stroke length adjusting shaft is provided with a bearing which is associated with a corresponding bearing within the uppermost ends of the stroke length set mount 120 as at 126 and 128. A collar 130 is mounted upon one end of the stroke length adjustment shaft and a second collar 132 is mounted upon the other end. A stroke adjustment shaft 134 is connected to collar 132 and, in turn, carries a stroke adjustment knob 136. Alternatively, a flexible stroke adjustment cable assembly could be provided to provide the same function. In any case, rotation of the stroke length adjustment shaft 122 will serve to effect translation of the stroke set slide block 68 within the stroke length set mount 120. This translation will, in turn, carry with it the position of the pivots of the first ends 70 and 72 of members 64 and 66 which form a part of the first link mechanism 62. Translation of these pivot points along top plate 44 will serve to vary the amplitude of the oscillating stroke of the other end 94 of the bell crank and thus the width of stroke of the polishing head assembly 20 which will be apparent from the discussion of the schematics below. Briefly, however, the second end of the bell crank 88 is pivotally mounted to a cam link 140 which, in turn, is pivotally mounted to an oscillating bracket 142 of an oscillation link 144. The oscillating link 144 extends along and is pivotally connected to an uppermost portion of a plurality of arm links 146 which are connected to corresponding oscillating shafts 22. The oscillating shafts 22, as previously discussed, serve to carry polishing head assemblies 20 which carry a polishing pad for finishing the contact lenses.

Sequence of Operation

Referring now to FIGS. 3, 4, and 5, there will be seen schematic views of the above-discussed dynamically variable oscillating adjustment assembly wherein various positions of adjustment have been shown.

Turning specifically to FIG. 3, it will be noted in the schematic representation that the longitudinal length between the pivotal axis at either end of the first link assembly 62, as represented by the second link 66, is identical in axial dimension with the second link assembly or means 80. Accordingly, it is possible that the pivotal axis of the first ends of links 64 and 66 could coincide with the pivotal axis of the other end 86 of link 82. In this event, and as shown in FIG. 3, the cam linkage 54 would merely serve to oscillate the first link means 62 and the second link means 80 in unison as the driver cam 48 is rotated by the gear motor assembly 40. In this pivotal mode, no drive motion is delivered to the first arm 90 of the bell crank 88 and thus the second arm 94 is also motionless. In this mode, the oscillating block shafts 22 are not rotated and correspondingly the polishing head assemblies do not oscillate.

Although the mode depicted in FIG. 3 is one possible configuration, it is not an operative one as envisioned by the instant invention. In order to achieve the desired oscillating effect the bottom most pivotal axes of the first link means 62 and the second link means 80 must not be coaxial. In order to provide a degree of stroke and to adjust the travel or width of stroke the set slide block 68 is adjusted such as to the right as shown in FIG. 4 by directional arrow "A". With this adjustment it will be seen that the pivot axis of the first ends 72 of the first link means 62 and the second member 66 thereof is offset with respect to the other end 86 of the second link means 80. Accordingly, as the cam linkage 54 oscillates back-and-forth under the influence of the driver cam 48, the bell crank 88 will be rocked about its intermediate pivot 98, note the phantom representations of the linkage members, to produce an angular oscillation as depicted by directional arrows 160 at the end 96 of the second bell crank arm 94. The second arm 94 of the bell crank, as previously discussed, is linked to a polishing head assembly 20 such that an arc of movement is achieved by the polishing head as represented by directional arrows 162.

In sum, and as indicated in FIG. 4, in order to change the width, amplitude, or magnitude of the oscillations of the polishing head assembly 20 it is only necessary to translate the stroke set slide block 68 which can be achieved while the machine is operating by rotation of the stroke adjustment knob 136.

Referring now to FIG. 5, it will be seen that the position of the polishing head assembly 20 may also be advantageously adjusted while the machine is operating by movement of the dovetail slide 100. In this connection, in FIG. 5, the offset of the stroke slide block 68 has been permitted to remain constant as previously viewed in connection with FIG. 5, while the dovetail slide 100 has been moved to the right as indicated by directional arrow "B". The effect of this movement is to change the position of pivot point 98 which in turn changes the position of oscillation of the polishing head assembly 20 as indicated by directional arrows 168.

It will be recognized by those skilled in the art that when the dovetail slide 100 is axially adjusted by manipulation of knob 110 the amplitude of oscillation will also be changed. Accordingly, the adjustment knob 136 may have to be slightly readjusted to establish the same amount of sweep. However, such adjustment can be facilely made as the machine is operating, as previously discussed.

Summary of Major Advantages of the Invention

After reviewing the foregoing description of a preferred embodiment of the invention, in conjunction with the drawings, it will be appreciated by those skilled in the art that several distinct advantages of the subject dynamically variable oscillating adjustment assembly are obtained.

Without attempting to detail all of the desirable features of the invention, as specifically and inherently disclosed above, the ability to adjust the stroke set slide block 68 with adjustment knob 136 while the machine is operating enables an operator to, at will and without stopping the machine, faciley make accurate adjustments to the width, amplitude, or stroke of oscillation of the polishing head.

In a manner somewhat similar to the above, the position of oscillation of the polishing head assembly may be advantageously adjusted or altered merely by rotating knob 108 and therefore translating the dovetail slide 100 and the intermediate pivot 98 of the bell crank 88.

The ability to adjust a running instrument has, in terms of both position and oscillating stroke, particular utility in the ophthalmic lens finishing industry as detailed above and constitutes a substantial saving in time and ease with which a final polishing operation for contact lenses may be achieved.

In describing the invention, reference has been made to a preferred embodiment. Those skilled in the art, however, and familiar with the disclosure of the subject invention, may recognize additions, deletions, modifications, substitutions, and/or other changes which will fall within the preview of the subject invention.

I claim:

1. A dynamically variable oscillating stroke and position adjustment assembly comprising:

a frame;

a first link means;

first means connected to said frame for pivotably connecting one end of said first link means to said frame;

a second link means pivotably connected at one end to the other end of said first link means;

a bell crank having a first arm and a second arm and an intermediate pivot;

second means connected to said frame for pivotably connecting said bell crank intermediate pivot to said frame, including means for adjusting the position of said bell crank intermediate pivot with respect to said frame and said one end of said first link means; and means for pivotably connecting said first arm of said bell crank to the other end of said second link means, wherein oscillation of said other end of said first link means will operaly oscillate said second arm of said bell crank and adjustment of the position of said bell crank intermediate pivot with respect to said one end of said first link means will operably vary the position of the oscillation of said second arm of said bell crank and the stroke of the oscillation thereof;

said first means connected to said frame for pivotably connecting said one end of said first link means to said frame includes means for translating said first link means with respect to said frame such that the pivot point of said first link means may be selectively adjusted with respect to said frame and said intermediate pivot of said bell crank to vary the stroke of the oscillation of said second arm of said bell crank.

2. A dynamically variable oscillating stroke and position adjustment assembly as defined in claim 1 wherein said means for adjusting the position of said bell crank intermediate pivot comprises:

a slide member for pivotably supporting said intermediate pivot of said bell crank; and means connected to said frame and said slide member for translating said slide member and thus said bell crank intermediate pivot with respect to said frame.

3. A dynamically variable oscillating stroke and position adjustment assembly as defined in claim 2 wherein:

said slide member includes a dovetail base position; and a block dimensionally compatible with said slide member being mounted on said frame for carrying said slide member and permitting translation of said slide member with respect to said block while limiting transverse excursion of said slide member.

4. A dynamically variable oscillating stroke and position adjustment assembly as defined in claim 1 wherein:

said first link means comprises, a first member;

a second member identical with said first member and being operably positioned parallel with respect to said first member;

one end of each of said mutually parallel first and second members being pivotably connected to said first means connected to said frame; and a drive stud shaft pivotably extending through an aperture at the other end of each of said first and second members.

5. A dynamically variable oscillating stroke and position adjustment assembly as defined in claim 4 and further comprising:

an oscillating drive means connected to one end of said drive stud shaft to oscillate said drive stud shaft; and means for pivotably connecting said one end of said second link means to the other end of said drive stud shaft such that said oscillating drive means, said aperture at the other end of said first and second member and said one end of said second link means are all coaxially and pivotably mounted upon said drive stud shaft.

6. A dynamically variable oscillating stroke and position adjustment assembly as defined in claim 5 wherein said oscillating drive means comprises:

a motor connected to said frame having an output shaft;

a drive cam connected to said output shaft; and a link pivotably connected at one end to said drive cam in a position radially offset from a pivot axis of said drive cam and pivotably connected at the other end to said one end of said drive stud shaft wherein actuation of said motor operably serves to oscillate said drive stud shaft about said one end of said first and second parallel members.

7. A dynamically variable oscillating stroke and position adjustment assembly as defined in claim 4 wherein said means for translating said first link means connected to said frame comprises:

a stroke set slide block pivotably mounted between said first ends of said mutually parallel first and second members;

a set mount connected to said frame and operable to receive said stroke set slide block; and means to selectively translate said stroke set slide block with respect to said set mount.

8. In an apparatus including an oscillation drive means, the improvement having a dynamically variable oscillating adjustment assembly comprising:

a frame;

a first link means;

first means connected to said frame for pivotally connecting one end of said first link means to said frame, including means for translating said first link means with respect to said frame such that the pivot point of said first link means may be selectively adjusted with respect to said frame;

a second link means pivotally connected at one end to the other end of said first link means;

a bell crank having a first arm and a second arm and an intermediate pivot;

second means connected to said frame for pivotally connecting said bell crank intermediate pivot to said frame; and means for pivotally connecting said first arm of said bell crank to the other end of said second link means, means for directly coupling said other end of said first link means and said one end of said second link means, with respect to any other portion of said first and second link means, to said oscillation drive means;

said oscillation drive means being operative via said coupling means to impart affirmative oscillation to said other end of said first link means and said one end of said second link means, both of which are thus positively driven by said oscillation drive means, for operatively oscillating said second arm of said bell crank, wherein adjustment of the position of said first link means with respect to said frame will operably vary the stroke of the oscillation of said second arm of said bell crank.

9. A dynamically variable oscillating width and position adjustment assembly as defined in claim 8 wherein:

said first link means comprises, a first member, a second member identical with said first member and being operably positioned parallel with respect to said first member, one end of each of said mutually parallel first and second members being pivotally connected to said first means connected to said frame; and a drive stud shaft pivotally extending through an aperture at the other end of each of said first and second members.

10. A dynamically variable oscillating adjustment assembly as defined in claim 9 and wherein said oscillating drive means being connected to one end of said drive stud shaft to oscillate said drive stud shaft; and said coupling means including means for pivotally connecting said one end of said second link means to the other end of said drive stud shaft such that said oscillating drive means, said aperture at the other ends of said first and second members, and said one end of said second link means are all coaxially and pivotally mounted upon said drive stud shaft.

11. A dynamically variable oscillating adjustment assembly as defined in claim 10 wherein said means for translating said first means connected to said frame comprises:

a stroke set slide block pivotally mounted between said first ends of said mutually parallel first and second members;

a set mount connected to said frame and operable to receive said stroke slide block; and means to selectively translate said stroke set slide block within respect to said mount.

12. A dynamically variable oscillating adjustment assembly as defined in claim 11 and further comprising:

means for adjusting the position of said bell crank intermediate pivot with respect to said frame and said one end of said first link means wherein the position of oscillation of said second arm of said bell crank may be selectively varied.

13. A dynamically variable oscillating adjustment assembly as defined in claim 12 wherein said means for adjusting the position of said bell crank intermediate pivot comprises:

a slide member for pivotally supporting said bell crank intermediate pivot; and means connected to said frame and said slide member for translating said slide member and thus said bell crank intermediate pivot with respect to said frame.

14. A dynamically variable oscillating adjustment assembly as defined in claim 8 and further comprising:

means for adjusting the position of said bell crank intermediate pivot with respect to said frame and said one end of said first link means wherein the positio of oscillation of said second arm of said bell crank may be selectively varied.

15. A dynamically variable oscillating adjustment assembly comprising:

a frame;

a first link means;

first means connected to said frame for pivotally connecting one end of said first link means to said frame, including means for translating said first link means with respect to said frame such that the pivot point of said first link means may be selectively adjusted with respect to said frame;

a second link means pivotally connected at one end of the other end of said first link means;

a bell crank having a first arm and a second arm and an intermediate pivot;

second means connected to said frame for pivotally connecting said bell crank intermediate pivot to said frame; and means for pivotally connecting said first arm of said bell crank to the other end of said second link means, wherein oscillation of said other end of said first link means will operably oscillate said second arm of said bell crank and adjustment of the position of said first link means with respect to said frame will operably vary the stroke of the oscillation of said second arm of said bell crank;

means for adjusting the position of said bell crank intermediate pivot with respect to said frame and said one end of said first link means wherein the position of oscillation of said second arm of said bell crank may be selectively varied.

16. A dynamically variable oscillating adjustment assembly as defined in claim 15 wherein said means for adjusting the position of said bell crank intermediate pivot comprises:

a slide member for pivotally supporting said bell crank intermediate pivot; and means connected to said frame and said slide member for translating said slide member and thus said bell crank intermediate pivot with respect to said frame.

* * * * *